US011149512B2

(12) United States Patent
Seidel et al.

(10) Patent No.: US 11,149,512 B2
(45) Date of Patent: Oct. 19, 2021

(54) SUBSEA UMBILICAL TERMINATION ASSEMBLY

(71) Applicant: ONESUBSEA IP UK LIMITED, London (GB)

(72) Inventors: Kersten Seidel, Nienhorst (DE); Jürgen Lohrer, Lachendorf (DE)

(73) Assignee: ONESUBSEA IP UK LIMITED, London (GB)

( * ) Notice: Subject to any disclaimer, the term of this patent is extended or adjusted under 35 U.S.C. 154(b) by 459 days.

(21) Appl. No.: 15/999,674

(22) PCT Filed: Jan. 31, 2017

(86) PCT No.: PCT/EP2017/000118
§ 371 (c)(1),
(2) Date: Sep. 13, 2018

(87) PCT Pub. No.: WO2017/140410
PCT Pub. Date: Aug. 24, 2017

(65) Prior Publication Data

US 2021/0054712 A1 Feb. 25, 2021

(30) Foreign Application Priority Data

Feb. 15, 2016 (EP) ..... 16000365

(51) Int. Cl.
*E21B 33/038* (2006.01)

(52) U.S. Cl.
CPC ..... *E21B 33/038* (2013.01)

(58) Field of Classification Search
CPC ..... E21B 33/038; E21B 33/0353
See application file for complete search history.

(56) References Cited

U.S. PATENT DOCUMENTS 3,877,520 A * 4/1975 Putnam ..... E21B 43/017 166/366
4,120,362 A 10/1978 Chateau et al.
5,295,848 A 3/1994 Mohn
2006/0201679 A1* 9/2006 Williams ..... E21B 33/047 166/344
2009/0288836 A1 11/2009 Goodall et al.
(Continued)

FOREIGN PATENT DOCUMENTS

EP 2690249 A1 1/2014
GB 2142480 A * 1/1985 ..... E21B 33/0385
(Continued)

OTHER PUBLICATIONS

International Search Report and Written Opinion issued in International Patent Appl. No. PCT/EP2017/000118 dated Apr. 4, 2017; 13 pages.

*Primary Examiner* — James G Sayre
(74) *Attorney, Agent, or Firm* — Eileen Pape

(57) ABSTRACT

A subsea umbilical termination assembly comprising a base (1), said base (1) includes a core frame construction (2) with elongated sides (3, 4) onto which support plates (5, 6, 7) are mounted, wherein at least a pair of mounting rails (12, 13) are respectively secured to the core frame construction (2) along elongated sides (3, 4) and said mounting rails (12, 13) are provided with positioning elements (16, 17) to allow a modular support plate arrangement, which is fixed to the mounting rails (12, 13).

20 Claims, 4 Drawing Sheets

(56) References Cited

U.S. PATENT DOCUMENTS

| | | | | |
|---|---|---|---|---|
| 2014/0027123 | A1* | 1/2014 | Organ | E21B 41/0007 166/339 |
| 2015/0027730 | A1* | 1/2015 | Hall | E21B 33/038 166/379 |
| 2019/0338613 | A1* | 11/2019 | Kibler | E21B 33/03 |

FOREIGN PATENT DOCUMENTS

| | | | |
|---|---|---|---|
| GB | 2142480 | A | 1/1985 |
| WO | 8803596 | A1 | 5/1988 |
| WO | 03002407 | A2 | 1/2003 |

* cited by examiner

SUBSEA UMBILICAL TERMINATION ASSEMBLY

The disclosure relates to a subsea umbilical termination assembly for effecting electrical and/or hydraulic and/or data transfer connections underwater.

BACKGROUND

Umbilicals are used for transmitting power, signals and fluids to and from a subsea installation. The subsea installation comprises at least one or more subsea umbilical termination assemblies usable with subsea wells, Christmas trees and/or other related subsea equipment for subsea extraction and/or distribution of a liquid and/or gaseous product from under the sea bed.

The subsea umbilical termination assembly performs underwater connections between said subsea installation and a remote terminal. A subsea umbilical termination assembly may have a base with supports to provide connection points and may comprise a lift point for lowering down the assembly from a surface to a submerged installation, for example.

As known from WO 88/03596 A1 it is not generally possible to make connections between the pipeline, umbilicals and the Christmas tree and/or the control module package on the surface before the pipeline, Christmas tree and/or umbilicals are lowered into the sea and therefore a number of these connections normally have to be made under water, which is in turn an intricate, expensive, complex and time-consuming operation.

Known from U.S. Pat. No. 5,295,848 A serious problems can arise in effecting the desired connections in such circumstances, due to misalignment of the parts to be connected, and the need to ensure integrity of the connections once they have been made.

Known from WO 03/002407 A1 is a subsea umbilical termination having a base which comprises a plate of steel or metal, or a perforated structure, like a H design or a grid design. The base has stabilizing connectors, which comprise pad eyes for connecting to a winch cable. A plurality of housing supports can be used to keep a housing and hydraulic connector apart from the base, so that a diver has accessibility to the hydraulic or electric flying leads for (dis)connection.

According to this document the subsea umbilical termination assembly has support panels being integrated or welded to the core frame. Both frame and support plates are load bearing items. Thus, according to WO 03/002407 A1 the subsea umbilical termination assembly has a ready-made construction which has to be laid out before the subsea umbilical termination is assembled.

SUMMARY OF DISCLOSED EMBODIMENTS

According to the present disclosure it is proposed a subsea umbilical termination assembly that comprises a base. Said base includes a core frame construction with elongated sides onto which support plates are mounted. At least a pair of mounting rails is respectively secured to the core frame construction oppositely the elongated sides. Further, said mounting rails are provided with positioning elements to allow a modular support plate arrangement, which is fixed to the mounting rails.

The subsea umbilical termination assembly may comprise a lifting eye as a lifting point which may be designed as any appropriate equipment for lifting purpose.

The at least one pair of mounting rails may be respectively secured to the core frame construction along oppositely arranged elongated sides to stiff the core frame construction.

A subsea umbilical termination assembly according to the present disclosure might allow to design the subsea umbilical termination assembly with a small outer diameter in combination with modular exchangeable support plates over a length of the subsea umbilical termination assembly. The exchangeable support plates might be differently bolted to carry hydraulic stab-plates, electrical connectors, fiber-optic connectors and/or valves in a modular way. It might be possible that nearly only the core frame of the base of the subsea umbilical assembly is a load-bearing part. Provided that it might also be possible that the support plates do not need to contribute to a load-bearing. Further the core frame according to the present disclosure might be friendly related to the assembly of internal and external components.

The mounting rails might be load-bearing parts. The mounting rails might have a curved profile structure. The load-bearing function and/or the profile structure of the mounting rails might improve the rigidity of the framework. The lifting ability might be enhanced. The subsea umbilical termination assembly might be handled via a lifting eye bar on top of the subsea umbilical termination assembly.

The mounting rails might be bended profiles having a 90° offset, wherein the offsets of a pair of mounting rails might be facing each other. A modular support plate combination might be easily assembled over the total length of the subsea umbilical termination.

The positioning elements might be positioning holes located on a table-track, which may be designed as a part of the mounting rail. The support plates might be fixed to both table-tracks of a pair of mountings rails by using overlying or inner supported fixing. This might allow to use support plates of different design for an assembly friendly core frame of the subsea umbilical termination.

The support plates of the support plate arrangement might be exchangeable. The present disclosure might enable individual application-oriented and custom-built solutions.

The support plates of the support plate arrangement might be bolted to carry hydraulic stab-plates, electrical connectors, fiber-optic connectors and/or valves. The present disclosure might relate to the typical internal and external components of a subsea umbilical termination.

The core frame structure might have a top side with at least one bar of lifting eyes. The at least one bar of lifting eyes might be centrically arranged on the top side of the core frame structure. Shackles might be fitted in this lifting eye bars to adjust the center of gravity of the subsea umbilical termination assembly. The subsea umbilical termination assembly might be installed with and without stab and hinge over, dependent on installation requirements.

The subsea umbilical termination assembly might be used in deep water applications of the oil and gas industry. Further details of the disclosure might be gathered from the following description of the drawings.

BRIEF DESCRIPTION OF THE DRAWINGS

The following embodiments of the present disclosure are explained in more detail with reference to the accompanying drawings. The drawings are not necessarily to scale. Certain features of the present disclosure may be shown exaggerated in scale, drawn to a smaller size or in somewhat schematic form and some details of conventional elements may not be shown in the interest of clarity and conciseness.

DETAILED DESCRIPTION OF THE DISCLOSED EMBODIMENTS

The disclosure relates to a subsea umbilical termination assembly. In embodiments, a subsea umbilical termination builds the end of an umbilical where the subsea umbilical termination is landed on a foundation base. The foundation base might be located on the seabed.

Figure 1:
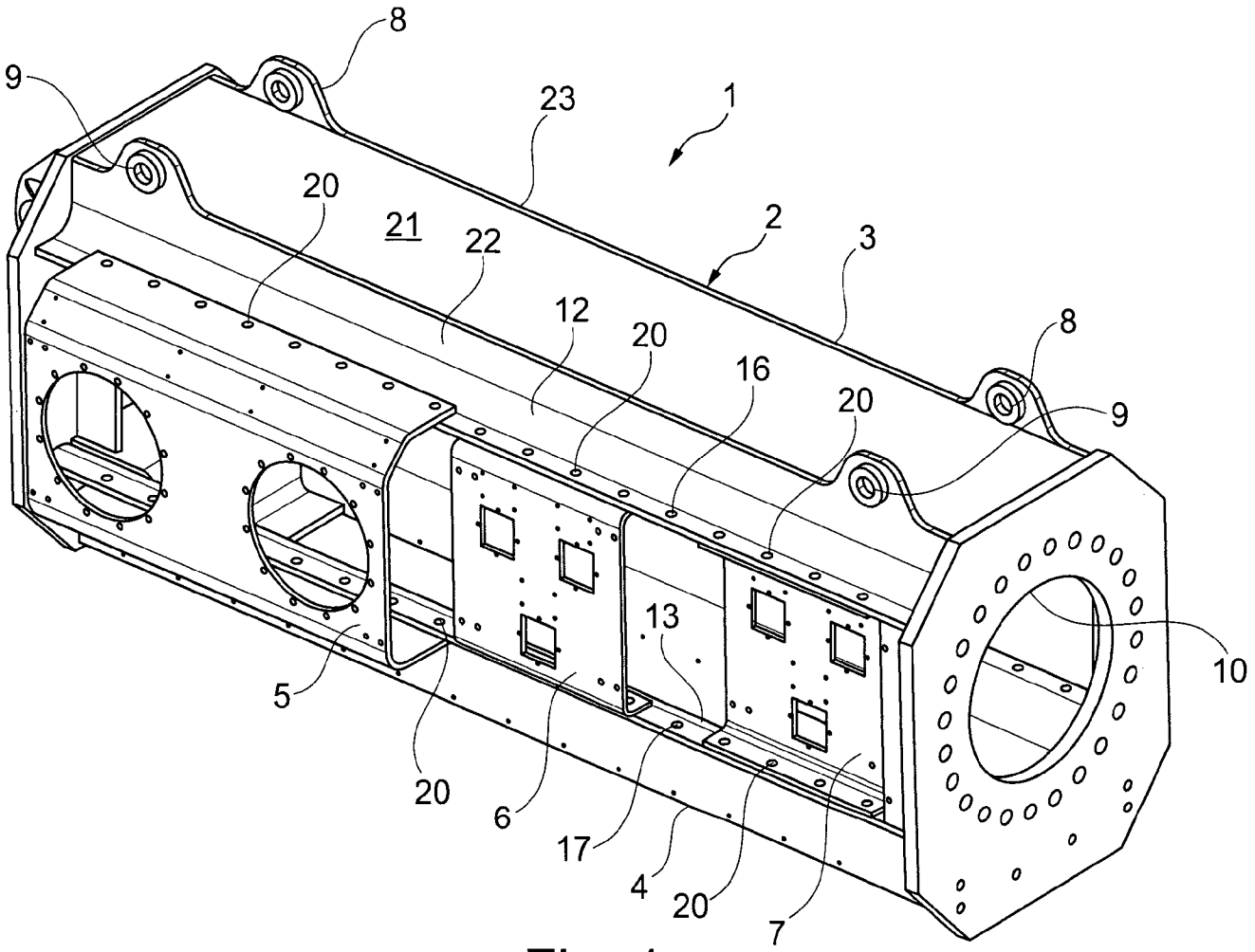
FIG. 1 is a schematic illustration of an embodiment of a base for a subsea umbilical termination according to one or more aspects of the present disclosure.
Figure 2:
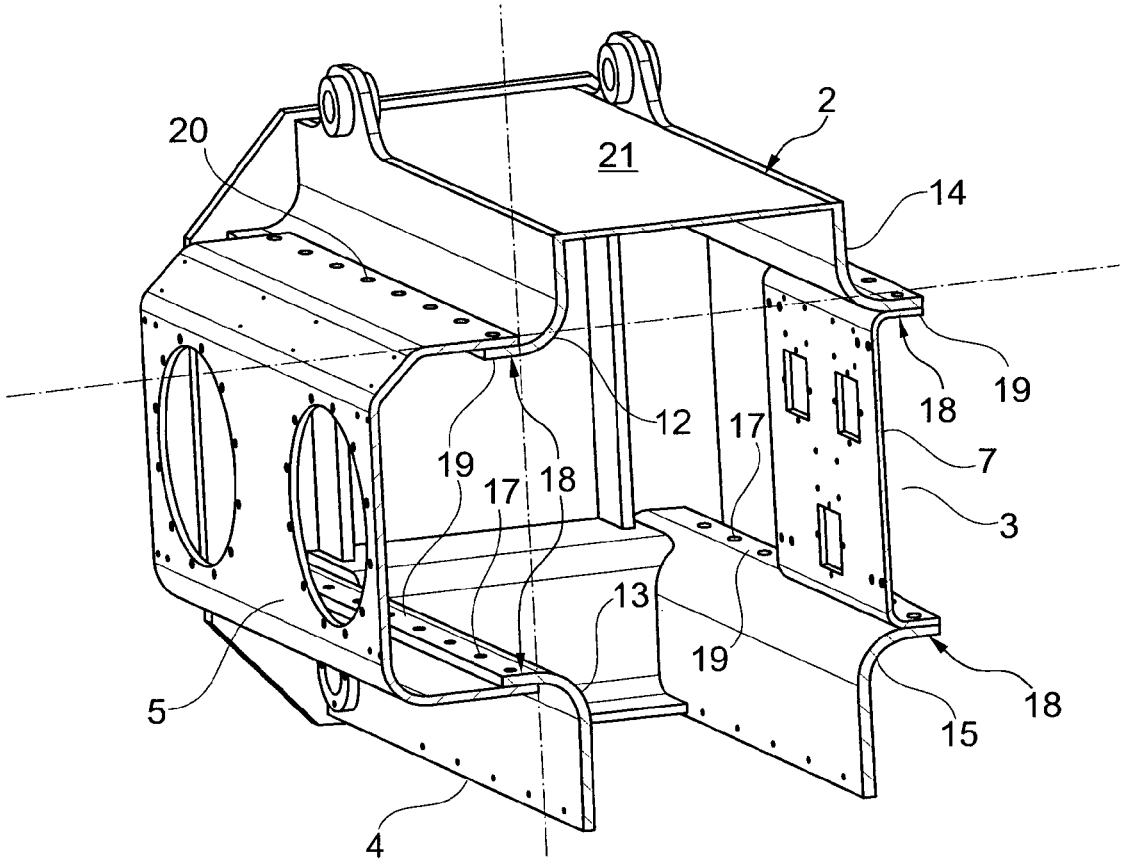
FIG. 2 is a schematic illustration of a cross section of the base shown in FIG. 1.
Figure 3:
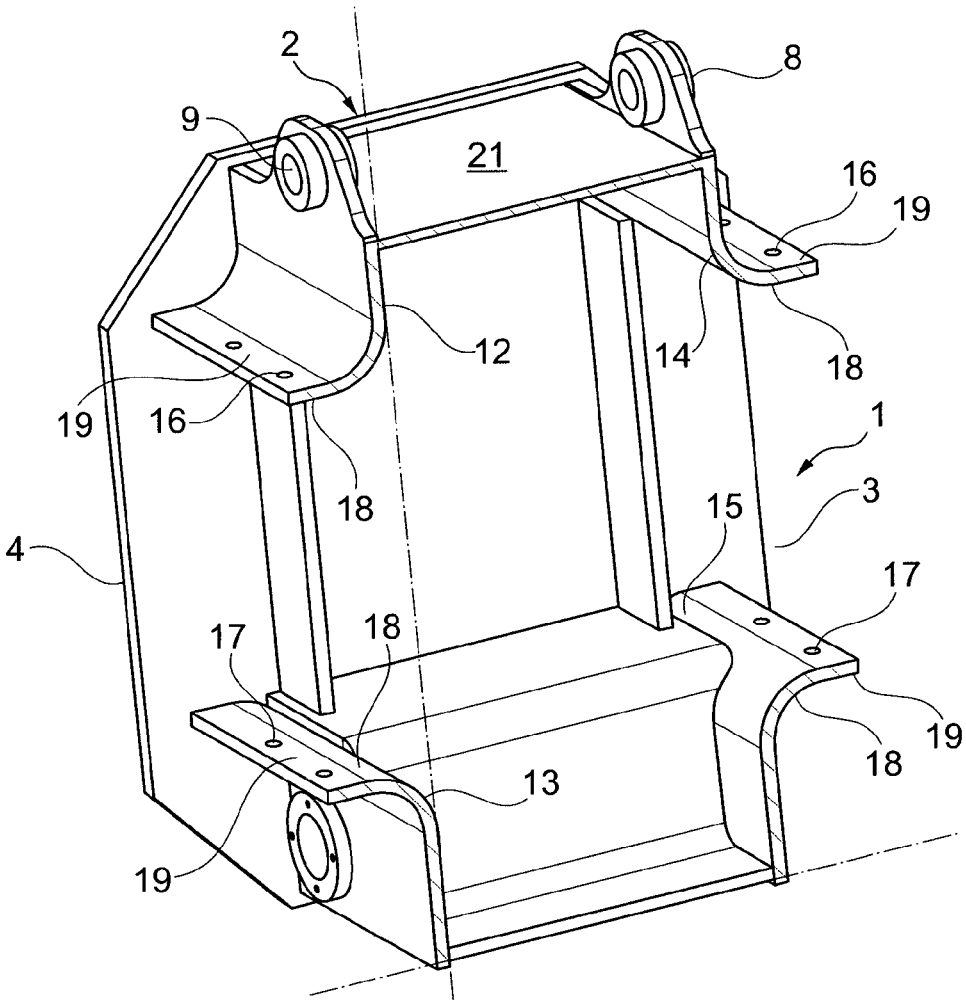
FIG. 3 is a schematic illustration of a cross section of the base shown in FIG. 1 without support plate.

FIG. 1 and FIG. 2 show an embodiment of a base 1 of a subsea umbilical assembly. Said base 1 includes a core frame construction 2 with elongated sides 3, 4 onto which support plates 5, 6, 7 are mounted. For locating the subsea umbilical termination assembly underwater, the base 1 may comprise at least one lifting eye 8, 9 or any other appropriate equipment for lifting purpose. On a facing side 10 a subsea umbilical (not shown) can be connected.

In one embodiment shown on FIG. 2, a pair of mounting rails 12, 13; 14, 15 are respectively secured to the core frame construction 2 oppositely arranged elongated sides 3, 4. The mounting rails might enable to stiff the core frame construction 2. In some embodiments the mounting rails 12, 13; 14, 15 of both pairs might be connected mostly rigidly to the base 1. In embodiments, the mounting rails 12, 13; 14, 15 might be welded on to the base 1 or might be formed integrally with the base 1. In an embodiment, the mounting rails 12, 13; 14, 15 are provided with a plurality of positioning elements 16, 17 located alongside the rails to allow a modular arrangement of support plates 5, 6, 7 when fixed to the mounting rails 12, 13; 14, 15.

In embodiments, the mounting rails 12, 13; 14, 15 might be load-bearing parts. In embodiments, the mounting rails 12, 13; 14, 15 might be straight or curved members and/or might be formed as rigid bars. In embodiments, the mounting rails 12, 13; 14, 15 might have a curved profile structure as shown in the figures. In embodiments, the mounting rails 12, 13; 14, 15 might be bended profiles having an offset 18. Due to this offset 18 the mounting rails 12, 13; 14, 15 project outwards. In some embodiments, the offsets 18 of a pair of mounting rails 12, 13; 14, 15 may face each other.

In embodiments, the positioning elements 16, 17 might be positioning holes located on a table-track 19, which is designed as a part of each of the mounting rails 12, 13; 14, 15.

In embodiments, the support plates 5, 6, 7 might be fixed to the table-tracks 19 of a pair of mounting rails 12, 13; 14, 15 by using overlying or inner supported fixing. In an embodiment presented on FIG. 1 and FIG. 2 the support plate 5 is fixed on rails 12, 13 and 14, 15 by overlying fixing and support plates 6, 7 are fixed on rails 12, 13 and 14, 15 by inner supported fixing.

The support plates 5, 6, 7 of any support plate arrangement might be exchangeable. In embodiments, the support plates 5, 6, 7 of any support plate arrangement might be bolted to the table-tracks 19 of a pair of facing mounting rails 12, 13; 14, 15 to carry hydraulic stab-plates, electrical connectors, fiber-optic connectors and/or valves and/or any internal and/or external component needed. In embodiments, a number of adjacent arranged bolted connections 20 might be used for the fixing of support plates 5, 6, 7.

Figure 4:
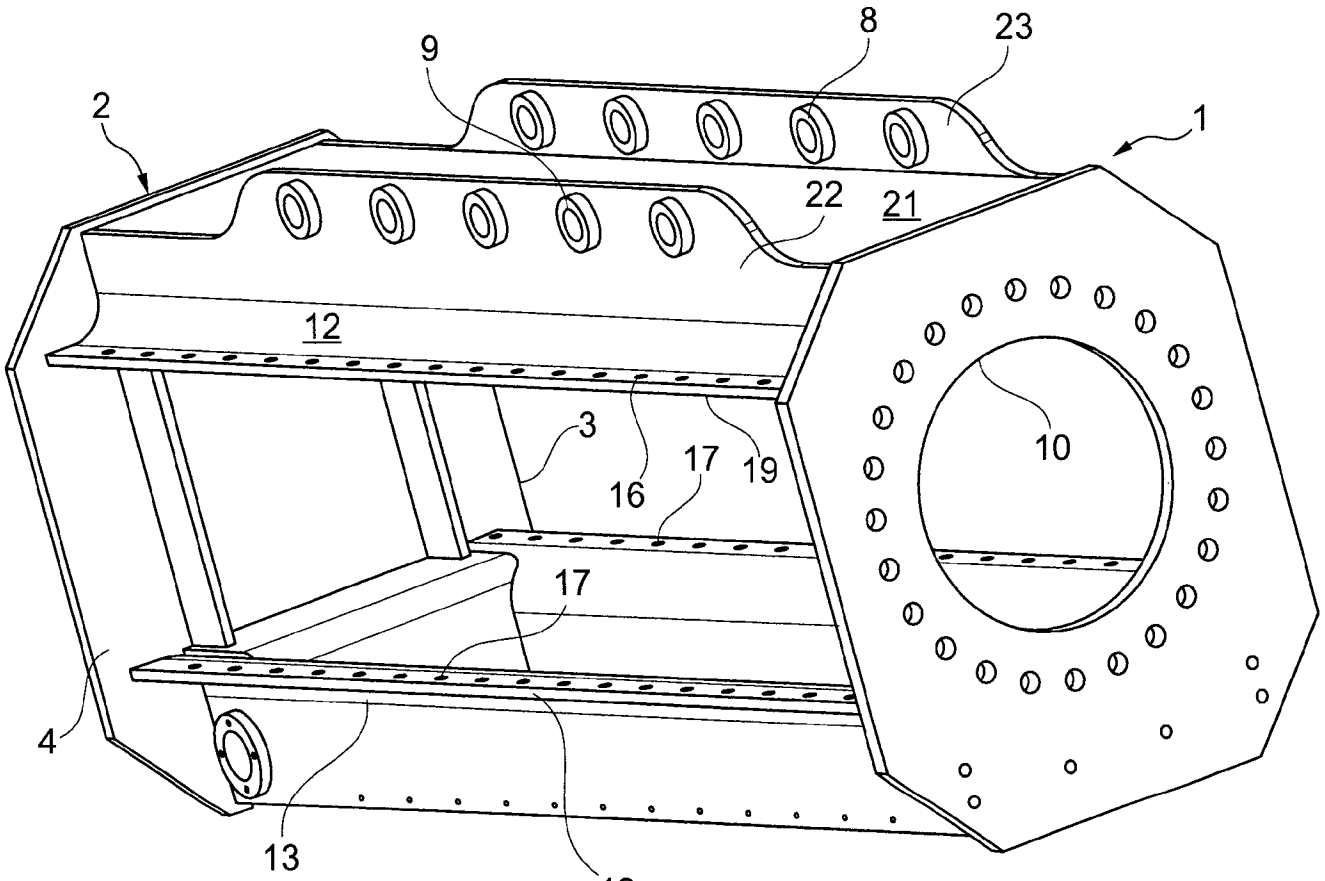
FIG. 4 is a schematic illustration of a second embodiment of a base for a subsea umbilical termination according to one or more aspects of the present disclosure.

In embodiments, the core frame structure 2 has a top side 21 with at least one bar 22, 23 of lifting eyes 8, 9. The at least one bar of lifting eyes might be centrically arranged. According to an embodiment shown in FIG. 1 the lifting eyes 8, 9 are arranged at the end of the bar 22, 23. According to another embodiment shown in FIG. 4 the lifting eyes 8, 9 are arranged along the length of the bar 22, 23. A number of lifting eyes 8, 9 might be arranged in a row.

The present disclosure is particularly useful for the use in deep water applications of the oil and gas industry.

Although the preceding description has been described herein with reference to particular devices, materials and embodiments, it is not intended to limited to the particulars disclosed herein; rather, it extends to all functionally equivalent structures, methods and uses, such as are within the scope of the appended claims.

The invention claimed is:

1. A subsea umbilical termination assembly, comprising:
a base having a core frame; and
a first pair of mounting rails coupled to a first side of the core frame, wherein each rail of the first pair of mounting rails comprises a first plurality of positioning elements configured to couple a first plurality of support plates to the first pair of mounting rails, and wherein the plates of the first plurality of support plates have different types of connections relative to one another.

2. The subsea umbilical termination assembly according to claim 1, wherein the first plurality of positioning elements comprises fastener elements arranged in series along each rail of the first pair of mounting rails.

3. The subsea umbilical termination assembly according to claim 1, wherein each rail of the first pair of mounting rails comprises an L-shaped cross-section extending in a lengthwise direction along a longitudinal axis of the core frame.

4. The subsea umbilical termination assembly according to claim 1, wherein the rails of the first pair of mounting rails are spaced apart from one another and extend along the first side of the core frame in a lengthwise direction along a longitudinal axis of the core frame, and each rail of the first pair of mounting rails comprises a table-track protruding outwardly from the first side of the core frame.

5. The subsea umbilical termination assembly according to claim 4, wherein the first plurality of positioning elements is located on the table-tracks of the first pair of mounting rails, and the first plurality of positioning elements comprises fastener holes, threaded fasteners, or a combination thereof.

6. The subsea umbilical termination assembly according to claim 4, wherein the first side of the core frame is open to a frame interior between the first pair of mounting rails defining a first side opening, and the first plurality of support plates is disposed over the first side opening.

7. The subsea umbilical termination assembly according to claim 1, wherein the first plurality of support plates are removable and exchangeable in a plurality of different positions along the first pair of mounting rails.

8. The subsea umbilical termination assembly according claim 1, wherein the different types of connections of the first plurality of support plates comprise hydraulic connectors, electrical connectors, fiber-optic connectors, and/or valves.

9. The subsea umbilical termination assembly according to claim 1, wherein one rail of the first pair of mounting rails comprises one or more lifting eyes.

10. The subsea umbilical termination assembly according to claim 1, comprising a second pair of mounting rails coupled to a second side of the core frame, wherein each rail of the second pair of mounting rails comprises a second plurality of positioning elements configured to couple a second plurality of support plates to the second pair of mounting rails.

11. The subsea umbilical termination assembly according to claim 1, wherein the plates of the first plurality of support plates have different dimensions relative to one another.

12. The subsea umbilical termination assembly according to claim 11, wherein the different dimensions comprises different lengths along the first pair of mounting rails, or different heights relative to the first side of the core frame, or a combination thereof.

13. The subsea umbilical termination assembly according to claim 1, wherein the plates of the first plurality of support plates comprise different sized openings relative to one another.

14. The subsea umbilical termination assembly according to claim 1, wherein at least one of the first plurality of support plates comprises a C-shaped cross-section extending lengthwise along the first pair of mounting rails.

15. A subsea umbilical termination assembly, comprising:

a base having a core frame; and a first pair of mounting rails coupled to a first side of the core frame and extending in a lengthwise direction along a longitudinal axis of the core frame, wherein each rail of the first pair of mounting rails comprises a first plurality of positioning elements configured to couple a first plurality of support plates to the first pair of mounting rails, wherein the core frame is open to a frame interior between the first pair of mounting rails defining a first side opening, and the first plurality of support plates is disposed over the first side opening.

16. The subsea umbilical termination assembly according to claim 15, wherein the first plurality of positioning elements comprises fastener elements arranged in series along each rail of the first pair of mounting rails.

17. The subsea umbilical termination assembly according to claim 15, wherein the first plurality of support plates are removable and exchangeable in a plurality of different positions along the first pair of mounting rails, wherein the plates of the first plurality of support plates have different dimensions, different sized openings, or different types of connections, relative to one another.

18. The subsea umbilical termination assembly according to claim 15, wherein each rail of the first pair of mounting rails protrudes outwardly from the first side of the core frame.

19. A subsea umbilical termination assembly, comprising:

a base having a core frame; and a first pair of mounting rails coupled to a first side of the core frame and extending in a lengthwise direction along a longitudinal axis of the core frame, wherein each rail of the first pair of mounting rails comprises a first plurality of positioning elements configured to couple a first plurality of support plates to the first pair of mounting rails, wherein each rail of the first pair of mounting rails protrudes outwardly from the first side of the core frame.

20. The subsea umbilical termination assembly according to claim 19, wherein at least one of the first plurality of support plates comprises a C-shaped cross-section extending in the lengthwise direction along the longitudinal axis and removably coupled to the first pair of mounting rails.

* * * * *